US011230920B2

(12) United States Patent
Camilleri

(10) Patent No.: US 11,230,920 B2
(45) Date of Patent: Jan. 25, 2022

(54) IDENTIFYING TUBING LEAKS VIA DOWNHOLE SENSING

(71) Applicant: Schlumberger Technology Corporation, Sugar Land, TX (US)

(72) Inventor: Lawrence Camilleri, La Defense (FR)

( * ) Notice: Subject to any disclaimer, the term of this patent is extended or adjusted under 35 U.S.C. 154(b) by 135 days.

(21) Appl. No.: 16/577,884

(22) Filed: Sep. 20, 2019

(65) Prior Publication Data

US 2020/0095861 A1 Mar. 26, 2020

Related U.S. Application Data

(60) Provisional application No. 62/734,815, filed on Sep. 21, 2018.

(51) Int. Cl.
*E21B 47/117* (2012.01)
*E21B 47/06* (2012.01)
*E21B 47/12* (2012.01)

(52) U.S. Cl.
CPC ..... *E21B 47/117* (2020.05); *E21B 47/06* (2013.01); *E21B 47/12* (2013.01)

(58) Field of Classification Search
CPC ..... E21B 47/117; E21B 47/06; E21B 47/12; E21B 47/10
See application file for complete search history.

(56) References Cited

U.S. PATENT DOCUMENTS 4,346,594 A * 8/1982 Owings ..... E21B 47/10 73/152.19
2010/0307743 A1* 12/2010 Ziuddin ..... E21B 47/10 166/250.03
2015/0090445 A1* 4/2015 Miller ..... E21B 47/09 166/255.1
2015/0354346 A1* 12/2015 Franklin ..... G01M 3/28 702/51
2015/0354347 A1* 12/2015 Franklin ..... E21B 47/117 702/51
2016/0201452 A1* 7/2016 Anisur Rahman ..... E21B 47/06 702/13
2017/0314357 A1* 11/2017 Kent ..... E21B 47/06
2017/0356291 A1* 12/2017 Spoerker ..... E21B 47/06

OTHER PUBLICATIONS

Al-Hussain, A. M. et al., "An Integrated Approach for Downhole Leak Detection", SPE 177996, presented at the SPE Saudi Arabia Section Annual Technical Symposium and Exhibition, Al-Khobar, Saudi Arabis, 2015, 13 pages.
Awaid, A. et al., ESP Well Surveillance using Pattern Recognition Analysis, Oil Wells, Petroleum Development Oman, IPTC 17413, presented at the International Petroleum , 22 pages.

(Continued)

*Primary Examiner* — Steven A Macdonald

(57) ABSTRACT

A technique facilitates detection of tubing leaks. The technique provides early detection of tubing leaks based on downhole sensing in a borehole, e.g. a wellbore. For example, a downhole sensor or sensors may be positioned to obtain downhole measurements of desired parameters, such as flowing pressure and flow rate. The downhole sensing may be used to identify departures from baseline parameters. Monitoring of those departures enables early detection of tubing leaks.

19 Claims, 7 Drawing Sheets

(56) References Cited

OTHER PUBLICATIONS

Han, G. et al., "Real-Time Monitoring and Diagnosis of Electrical Submersible Pump", SPE 174873, presented at the SPE Annual Technical Conference and Exhibition, Houston, Texas, U.S.A, 2015, 20 pages.

Michel, C. M., "Methods of Detecting and Locating Tubing and Packer Leaks in the Western Operating Area of the Prudhoe Bay Field", SPE 21727, SPE Productions & Facilities, 1995, 10(2), pp. 124-128.

* cited by examiner

IDENTIFYING TUBING LEAKS VIA DOWNHOLE SENSING

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 62/734,815, filed Sep. 21, 2018, the entirety of which is incorporated by reference herein and should be considered part of this specification.

BACKGROUND

In many hydrocarbon well applications, various types of tubing strings may be deployed downhole in a borehole. For example, tubing strings may comprise completion equipment deployed in a wellbore to facilitate production of hydrocarbon fluids, e.g. oil and/or gas. In some embodiments, the tubing string may include an electric submersible pumping system, which provides artificial lift to deliver hydrocarbon fluids to the surface. However, tubing leaks along tubing strings are a fairly common problem in the oil industry. Tubing leaks can cause millions of dollars of losses due to deferred production when the oil leak problem goes unnoticed. In some operations, leaks may start as pinholes resulting from corrosion and subsequently grow because of erosional flow. However, traditional well monitoring methods have been insufficiently sensitive and can result in leaks remaining unnoticed for prolonged periods.

SUMMARY

In general, a methodology and system are provided which facilitate detection of tubing leaks. The technique provides early detection of tubing leaks based on downhole sensing. For example, a downhole sensor or sensors may be positioned to obtain downhole measurements of desired parameters, such as flowing pressure and flow rate. The downhole sensing may be used to identify departures from baseline parameters. Monitoring of those departures and use of the data collected, as described herein, enables early detection of tubing leaks.

In some configurations, a method of downhole monitoring includes locating a tubing string in a borehole; providing a flow of fluid through the tubing string; positioning a sensor along the tubing string to obtain data related to the flow of fluid; and based on the data related to the flow of fluid, determining a sloped change of the inverse of the rate-normalized pressure difference to provide a unique indicator of a tubing leak.

Providing the flow of fluid can include operating an electric submersible pumping system. Positioning the sensor can include positioning a flowmeter downhole along the tubing string. The sensor can be used to obtain data on flowing pressure along the tubing string. The method can further include converting the data to a log-log plot. The method can include using the log-log plot to further accentuate a change in slope indicative of the tubing leak. The method can include automating the detection of the tubing leak.

In some configurations, a method of detecting a tubing leak in a well includes obtaining data related to a flow of fluid through a tubing string deployed in the well; and processing the data to detect the tubing leak by identifying a rate-normalized pressure drop and a change in a derivative of an inverse of the rate-normalized pressure drop.

The method can include providing an alarm when the tubing leak is detected. Obtaining data can include obtaining data from one or more sensors disposed upstream of the tubing leak. Processing the data can include creating a plot of $Q_m/(P_i-P_{wf})$ with respect to time, where $Q_m$ is a total downhole fluid flow rate at a monitored location, $P_i$ is an initial reservoir pressure, and $P_{wf}$ is a downhole fluid flow pressure at the monitored location. Processing the data can include creating a log-log plot of $Q_m/(P_i-P_{wf})$ with respect to time. The tubing leak can be detected when Qm/(Pi−Pwf) begins increasing over time and/or when a slope of the plot changes and/or becomes positive.

In some configurations, a system for detecting a tubing leak in a well includes at least one sensor disposed along a tubing string deployed in the well; and a processor configured to: receive data from the at least one sensor; process the data to identify a rate-normalized pressure drop and a change in a derivative of an inverse of the rate-normalized pressure drop; and output information indicative of the tubing leak to a user.

The process can be configured to create a plot of $Q_m/(P_i-P_{wf})$ with respect to time, where $Q_m$ is a total downhole fluid flow rate at a monitored location, $P_i$ is an initial reservoir pressure, and $P_{wf}$ is a downhole fluid flow pressure at the monitored location, and wherein the information comprises the plot. The processor can be configured to automatically detect the tubing leak based on $Q_m/(P_i-P_{wf})$ beginning to increase over time. The system can include an alarm, and the processor can be configured to trigger the alarm when the tubing leak has been detected. The at least one sensor can be disposed upstream of the tubing leak. The at least one sensor can include a flowmeter.

However, many modifications are possible without materially departing from the teachings of this disclosure. Accordingly, such modifications are intended to be included within the scope of this disclosure as defined in the claims.

BRIEF DESCRIPTION OF THE FIGURES

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
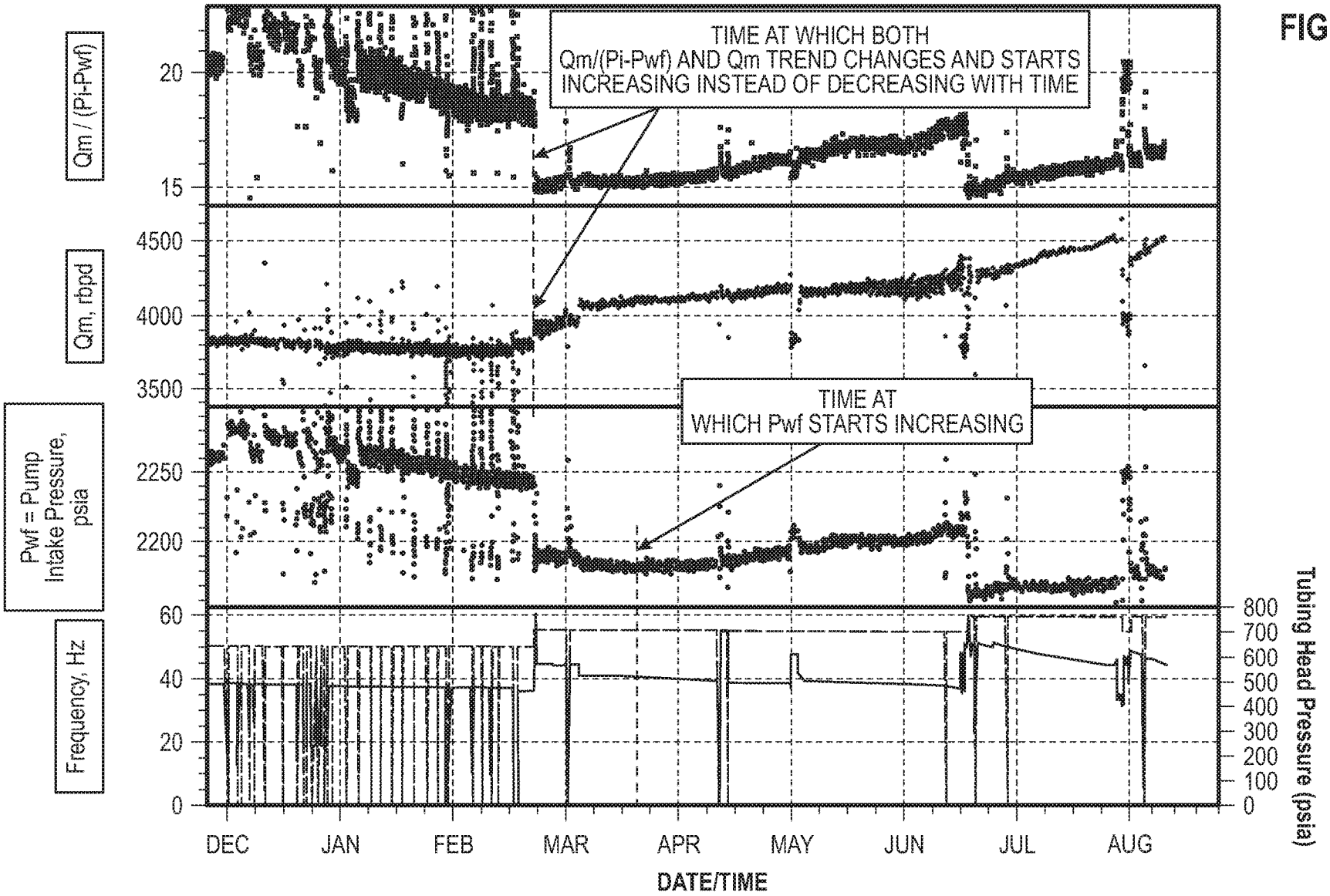
FIG. 1 is a graphical illustration demonstrating utilization of a downhole sensor system in a manner enabling early detection of a tubing leak, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system which facilitate detection of tubing leaks. The technique provides early detection of tubing leaks based on downhole sensing. For example, a downhole sensor or sensors may be positioned to obtain downhole measurements of desired parameters, such as flow rate and flowing pressure. The downhole sensing may be used to identify departures from baseline parameters. Monitoring of those departures and use of the data collected, as described in greater detail below, enables early detection of tubing leaks.

In oil well applications, oil wells produce according to a particular reservoir flow regime. This flow regime provides a baseline which can be identified using, for example, a downhole liquid flowmeter and gauge or other suitable sensors. Departure from this flow regime can be used as a tubing leak factor which signifies a tubing leak. A rate-normalized pressure drop and a change in the derivative of the inverse of this drop amplify the leak effect and thus enable early detection. The rate-normalized pressure drop and the change in the derivative of the inverse of this drop may be used as the tubing leak factor signifying a tubing leak. It should be noted that flow regimes in an oil well can change over time as is the case in unconventional well applications, e.g. multi-stage fracing of horizontal well applications. For example, the flow regimes may progress through three types of flow regimes (bi-linear, linear, and boundary dominated flow). However, this does not negatively affect leak detection techniques as described herein.

FIGS. 1-6 illustrate graphs from case studies applying and demonstrating the effectiveness of techniques described herein. The wells selected for these case studies were equipped with electric submersible pumps to produce flow through the tubing string and thus had abundant real-time data. This data enabled calculation of the liquid rate trend and measurement of the flowing pressure at desired points in the completion upstream of the tubing section of interest. In one case, for example, a leak was detected a month earlier versus traditional qualitative observation of, for example, flowing pressure. Furthermore, with traditional qualitative observation the interpretation of a leak would not have been conclusive.

As explained in greater detail below, a change in slope (or derivative) of the rate-normalized pressure drop is important because there is a change in the sign of the derivative, thus enhancing ease of leak detection. Utilization of this tubing leak factor enables a much earlier detection with substantially greater confidence, for example, compared to conventional or previously existing techniques. Early leak detection has potentially multiple benefits. For example, early leak detection may facilitate avoidance of deferred production, provides more time to arrange an intervention, enables improved rig management, and/or provides a variety of other benefits. When leak detection is based on the derivative of the inverse of the rate-normalized pressure drop, the absolute accuracy of the flow rate is not important provided the repeatability is acceptable, e.g. constant inaccuracy or constant bias. Consequently, downhole flowmeters need not be calibrated and a trend is sufficient to facilitate leak detection.

The tubing leak factor described herein provides other benefits in addition to early leak detection, e.g. early automated leak detection. For example, the tubing leak factor lends itself to being programmed into a programmable control system, e.g. a programmable logic controller, which can be located at a wellsite or run off data from a historian. In various applications, alarms may be used to indicate detection of a leak based on the tubing leak factor. This allows, for example, a rig operator to take appropriate action immediately and/or without the time delay of lengthy data interpretation, slickline logging, or both to verify the leak.

Figure 7:
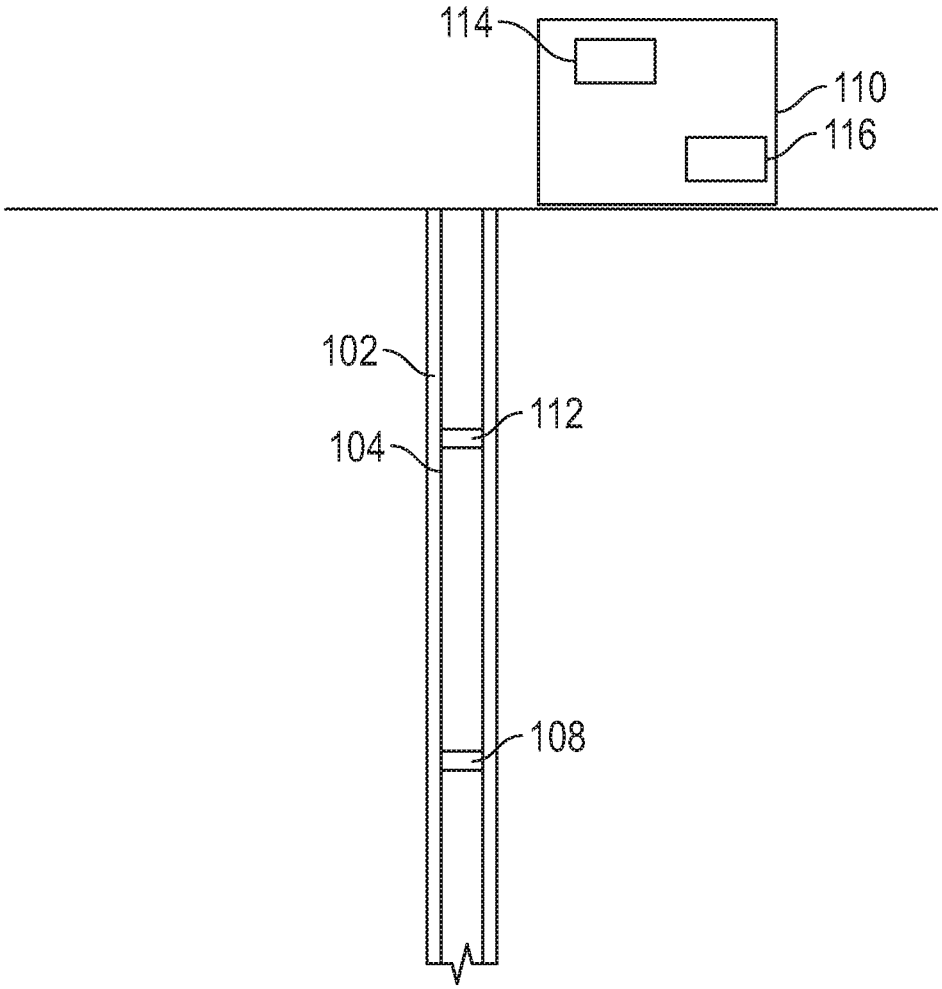
FIG. 7 schematically shows a system according to an embodiment of the disclosure.

Systems according to the present disclosure can include one or more sensors and a programmable control system, e.g., a programmable logic controller, processor, or controller. The sensor(s) can include a downhole liquid flowmeter, gauge, flow rate sensor(s), flow pressure sensor(s), and/or other suitable sensor(s). The programmable control system, programmable logic controller, processor, or controller is programmed with techniques and/or methods according to the present disclosure to detect a leak based on data from the sensor(s). The system can include a display to display data from the sensor(s), information and/or results from processing the data, e.g., graphical illustrations, and/or alerts, warnings, or the like. The system can include means, such as visual display and/or audio means, to provide alarms, alerts, warnings, or the like, e.g., visual and/or audible alarms, alerts, warnings, or the like, to a user or observer, for example, in the event a leak is detected. For example, FIG. 7 schematically illustrates a well including a tubing string 104 disposed within a casing 102 in a well. A leak 112 has developed in the tubing 104. As shown, one or more sensors 108 are disposed upstream of the leak 112. A surface system 110 includes a processor 114 and a user interface 116. Data from sensor(s) 108 can be transmitted to the surface system 110 via wired or wireless communication methods. The processor 114 is programmed with the leak detection methods and techniques described herein. The user interface 116 can include a display and/or one or more means for providing visual and/or audio alarms, alerts, warnings, or the like.

The technique described herein effectively provides an analytical technique, e.g. an analytical algorithm, able to take advantage of a downhole sensor, e.g. a downhole flowmeter and pressure gauge, in a manner which enables early, automatic leak detection. In this context, an "analytical" technique refers to a method which processes data using physics and is therefore proven from first principles and always true. This provides both improved confidence and early detection capability compared to traditional techniques using, for example, correlations which are partially based on physics and applied to a studied data set (thus producing results which may not be true). Other existing techniques may require a learning period for the software used and may or may not be based on physics.

The early leak detection technique according to the present disclosure can be particularly important in a production environment where automation may be very beneficial. Rapid leak detection also is important to avoid deferred production and for planning intervention such as tubing replacement or running a tubing patch. Examples of leaks which may be detected include leaks resulting from holes caused by corrosion. Such holes usually start as pinholes and then grow as erosion flow takes place. Artificial lift equipment can sometimes increase the pressure and temperature thus accelerating the chemical process of corrosion.

Leaks also may result from holes caused by mechanical wear. An example of mechanical wear is "rod wear" resulting from the motion of rods used for driving sucker rod pumps and progressive cavity pumps. Holes also may result from completion tools which inadvertently or accidentally remain open. Examples of such completion tools include sliding sleeve doors, circulating valves, and a variety of other types of downhole tools. The leak detection technique may be used in many types of well systems having various types of completions and/or lift mechanisms. The technique also may be used with many methods for measuring liquid flow rate at measurement locations upstream of the tubing where the leak detection is to be observed.

A methodology for early leak detection utilizing a rate-normalized pressure drop and a change in the derivative of the inverse of this drop is explained in further detail below.

Reservoir Flow Regime Concept

Oil wells produce according to a particular flow regime at a given time. By way of example, this may be IARF (Infinite Acting Radial Flow), bi-linear flow, linear flow, and/or BDF (Boundary Dominated Flow). Therefore, a ratio of $(P_i-P_{wf})/Q_r$ has a constant slope when plotted against either elapsed time or log of time. An algorithm which provides the relationship between the rate normalized pressure drop in the reservoir and time is given in Equation 1. This equation is for 3 flow regimes; similar equations exist for IARF as a function of ln(time). This ratio allows the engineer, for example, to carry out diagnostic plots which identify periods of constant flow regime. Equation 1 can be expressed as:

$$\frac{P_i - P_{wf}}{Q_r} = at^n + b \qquad \text{Equation 1}$$

where:

a and b are constants n=0.25 and 0.5 for fracture linear and bi-linear flow n=1 Unit slope for BDF—Boundary Dominated Flow Flowrates to be Considered Equation 2 below expresses that a total flow rate of oil and water measured by a downhole flowmeter, $Q_m$, equals an inflow rate of liquid from the reservoir, $Q_r$, plus a tubing leak rate, $Q_l$.

$$Q_m = Q_r + Q_l \qquad \text{Equation 2}$$

Evaluating the Impact to the Flow Regime Trend $$F = \frac{Q_m}{P_i - P_{wf}} = \frac{Q_r + Q_l}{P_i - P_{wf}} = \frac{Q_r}{P_i - P_{wf}} + \frac{Q_l}{P_i - P_{wf}} \qquad \text{Equation 3}$$

$$F = \frac{1}{at^n + b} + \frac{Q_l}{P_i - P_{wf}}$$

The formulation of Equation 3 presented above allows for separation of the effect of the reservoir inflow (flow regime) and the effect of the leak. Therefore, techniques according to the present disclosure consider the inverse of the inverse of (Pi-Pwf)/Qm. The technique involves subsequently investigating the derivative with respect to time, expressed as Equation 4 below, as the technique looks for a change in trend, which can be observed to detect the onset of a tubing leak.

$$Derivativewrttime = F' = -\frac{nat^{n-1}}{(at^n + b)^2} + \frac{Q_l'(P_i - P_{wf}) + Q_l P_{wf}'}{(P_i - P_{wf})^2} \qquad \text{Equation 4}$$

The below table examines the sign of the derivative.

| | |
|---|---|
| $-\frac{nat^{n-1}}{(at^n + b)^2}$ | This term relates to the trend before / without the leak and is only a function of the reservoir flow regime<br>This term is generally negative as 'a' is positive.<br>The one instance when this term is positive is when the drainage area is being pressurized and therefore reservoir pressure is increasing with time.<br>Although the equations presented above can be used for 3 flow regimes, an analogous term for IARF would also be positive, i.e. the derivative of (Pi-Pwf)/Qr |
| $\frac{Q_l'(P_i - P_{wf}) + Q_l P_{wf}'}{(P_i - P_{wf})^2}$ | Considering two cases:<br>1) Case 1: The leak rate is constant with time.<br>This is rare as holes caused by wear or corrosion usually grow in size with time and the leak rate therefore also increases with time. The leak rate is constant → $Q_l' = 0$, the sign is therefore dependent on $Q_l P_{wf}'$. The effect of the leak is to reduce the reservoir production, therefore $P_{wf}'$ is usually >0 and this term is therefore positive. This may not be the case initially as shown by the example in FIGS. 1-3, but eventually the Pwf increases as the leak rate increases.<br>2) Case 2: Leak rate increasing with time<br>This is the most common case and this term becomes positive except where $\lvert P_{wf}'\rvert > \lvert Q_l'\rvert$, i.e., rate of pressure depletion is greater than rate at which leak rate increases, which is rare as drawdown is reduced by the leak. |

Nomenclature

The nomenclature used for the equations herein includes:

| | |
|---|---|
| a and b | Constants with respect to time which define the analytical form of flow regime. |
| Pi | Initial reservoir pressure, constant wrt time |
| Pwf | Downhole flowing pressure at the same point as flow is measured, common units are psi |
| Qm | Downhole flowmeter measuring total rate of oil and water, common units are RBPD |
| Qr | Inflow Liquid rate from reservoir, bpd |
| Ql | Tubing leak rate, bpd |

As shown above, the slope (i.e. derivative) change of the inverse of the rate normalized pressure difference (or its inverse) provides a unique indicator for tubing leak detection, thus enabling automation of detection. In many cases, the change in slope is substantial as there is a change in sign of the derivative. The rate normalized pressure difference may be the parameter used to identify the flow regime in the near wellbore drainage area. A log-log plot of the same parameter accentuates the change in sign of the derivative, thus further enhancing ease of automatic detection.

Figure 2:
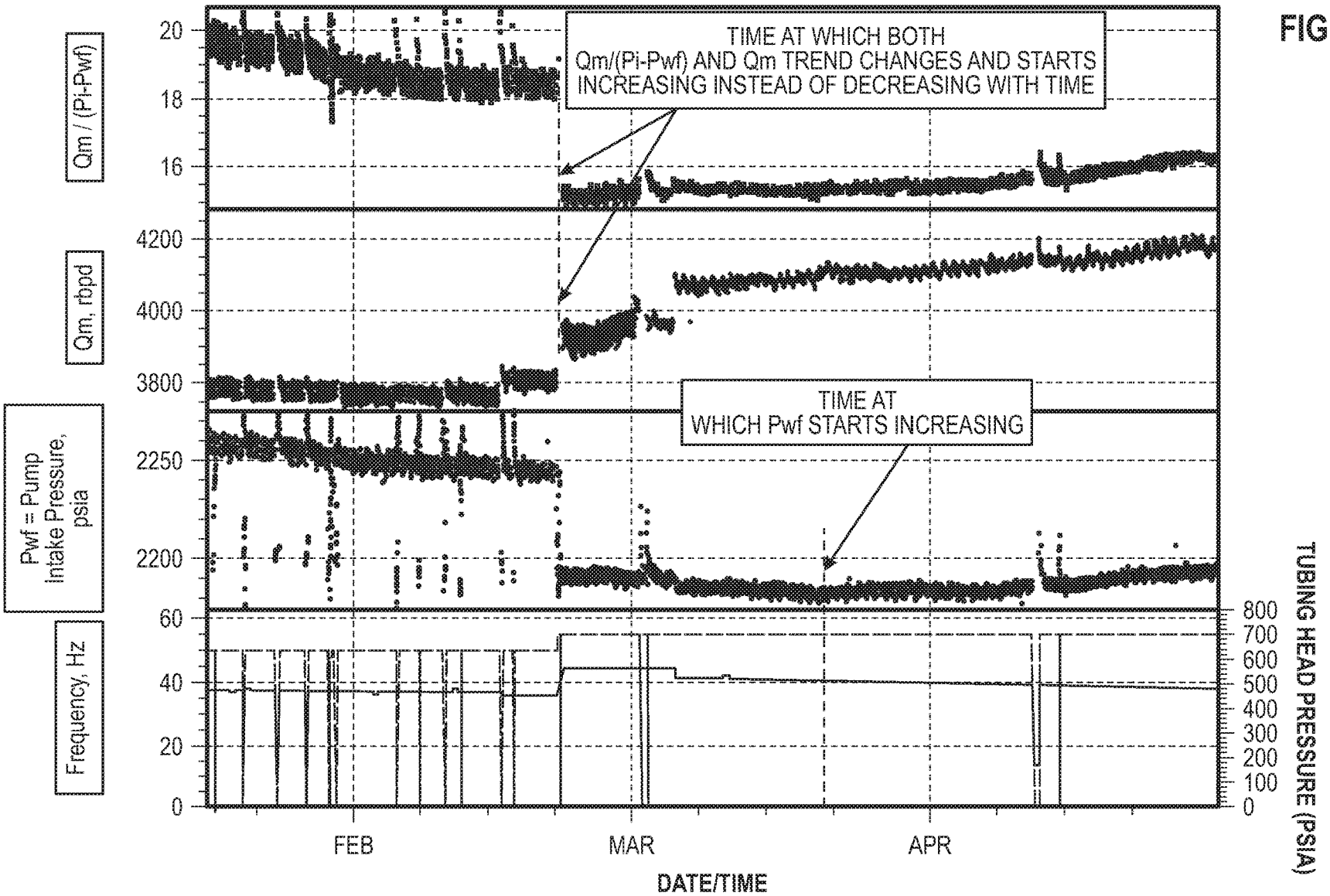
FIG. 2 is graphical illustration showing a portion of the graph illustrated in FIG. 1, according to an embodiment of the disclosure.
Figure 3:
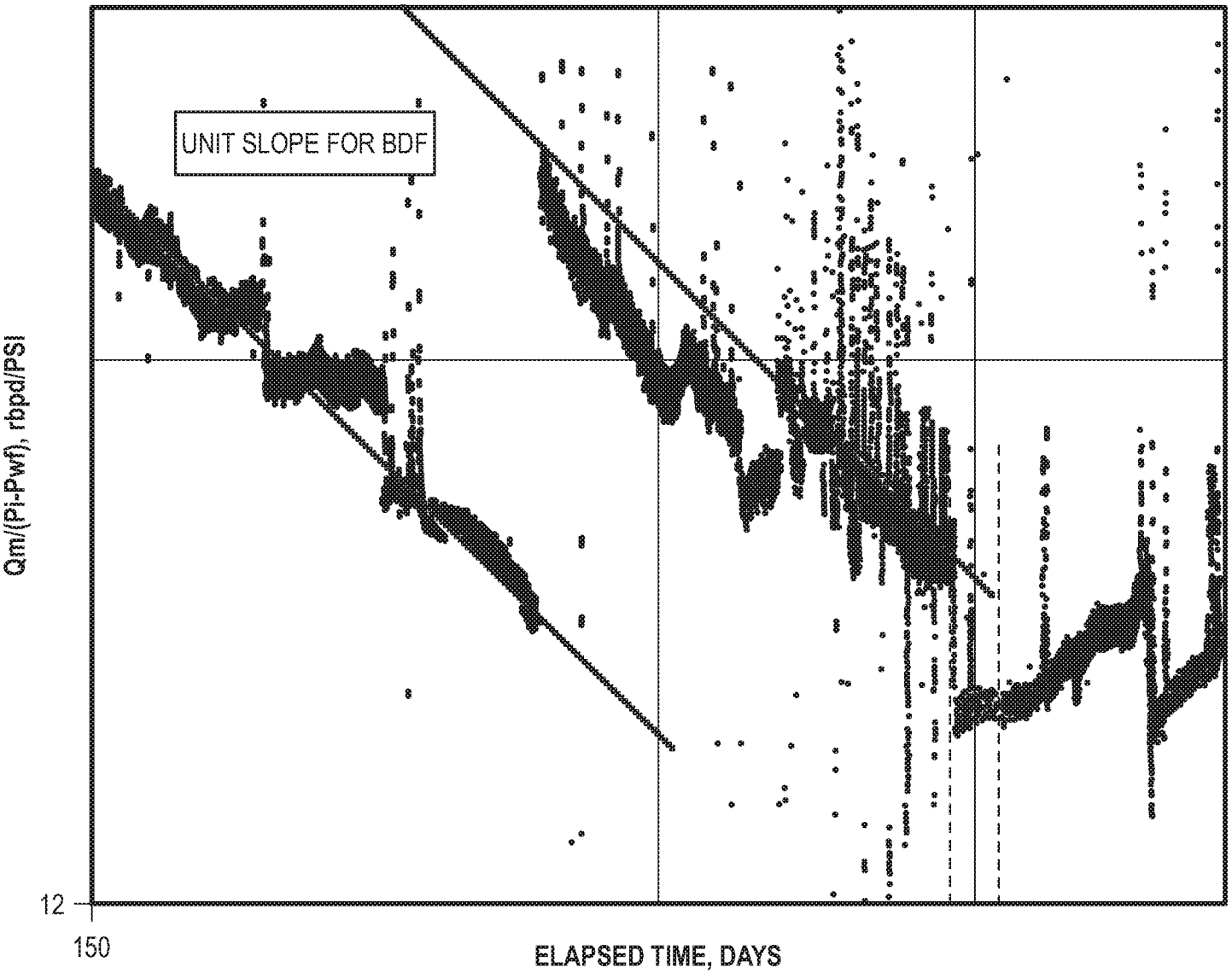
FIG. 3 is a graphical illustration showing a log-log plot of a flow regime based on data from the downhole sensor system, according to an embodiment of the disclosure.

Various case studies were conducted to verify the early leak detection technique described herein, and data/results from those case studies are presented graphically in FIGS. 1-6. For example, FIGS. 1-3 illustrate data obtained from a vertical conventional well. In FIGS. 1-2, a graphical example is provided in which data obtained by a sensor, e.g. a downhole flowmeter, shows the flowing pressure continues to decline although at a slower rate. The derivatives of the downhole flowmeter data and the slope of $Q_m/(P_i-P_{wf})$ change sign much earlier (one month earlier in this example) than would be detectable by conventional techniques, for example, when $P_{wf}$ starts increasing. This example demonstrates that $|P'_{wf}|<|Q'_i|$.

This demonstrates the value of the downhole flowmeter and current technique with respect to early detection of a tubing leak. The tubing leak factor serves as an indicator which provides an advanced warning of a tubing leak. A log-log plot, as illustrated in FIG. 3, can further enhance the ease of detecting a tubing leak. The log-log plot can accentuate the change in slope as the time exponent becomes the slope. In the illustrated example, the flow regime prior to the tubing leak is BDF with a unit slope.

Figure 4:
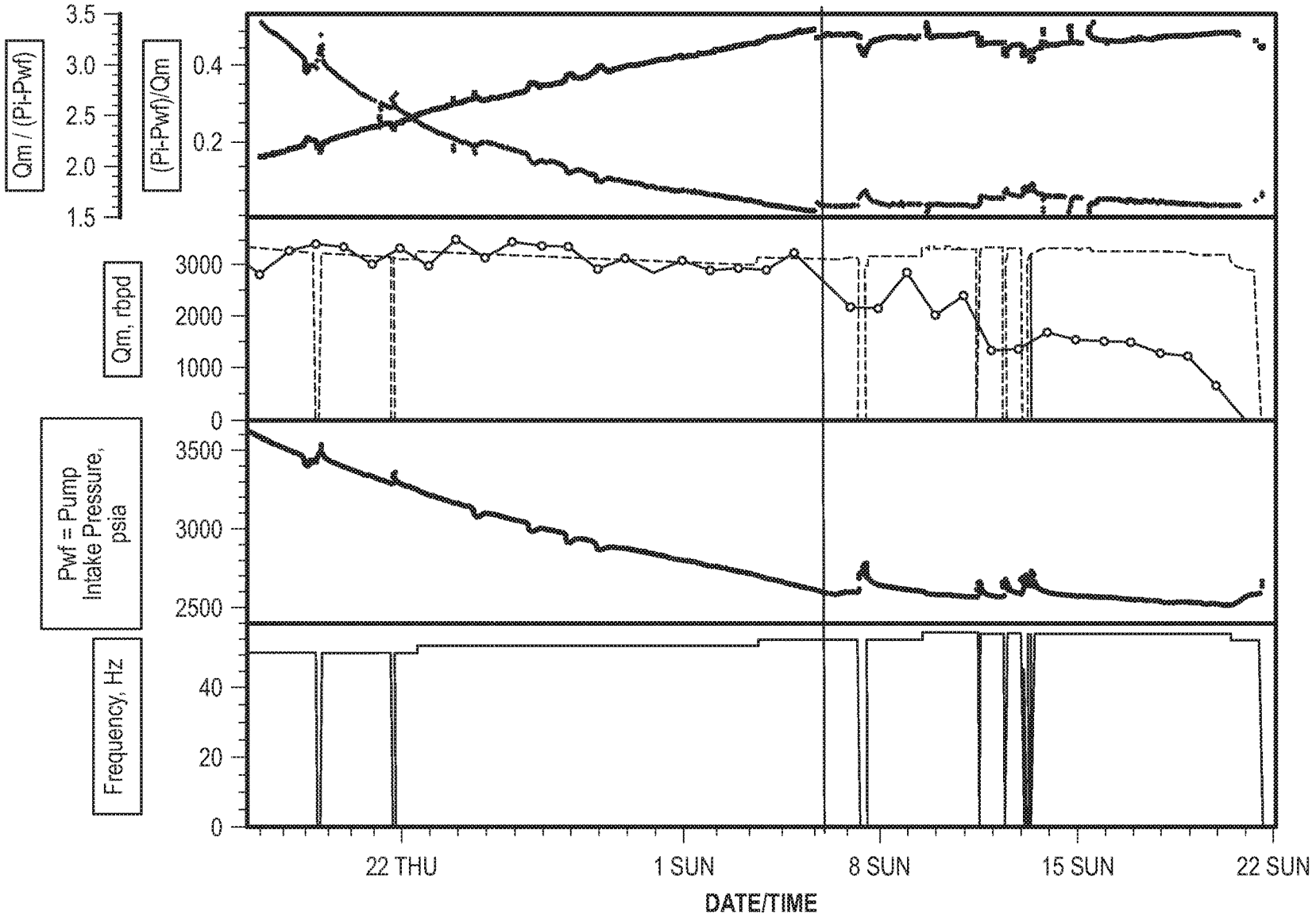
FIG. 4 is a graphical illustration showing detection of a tubing leak via complementary techniques, according to an embodiment of the disclosure.
Figure 5:
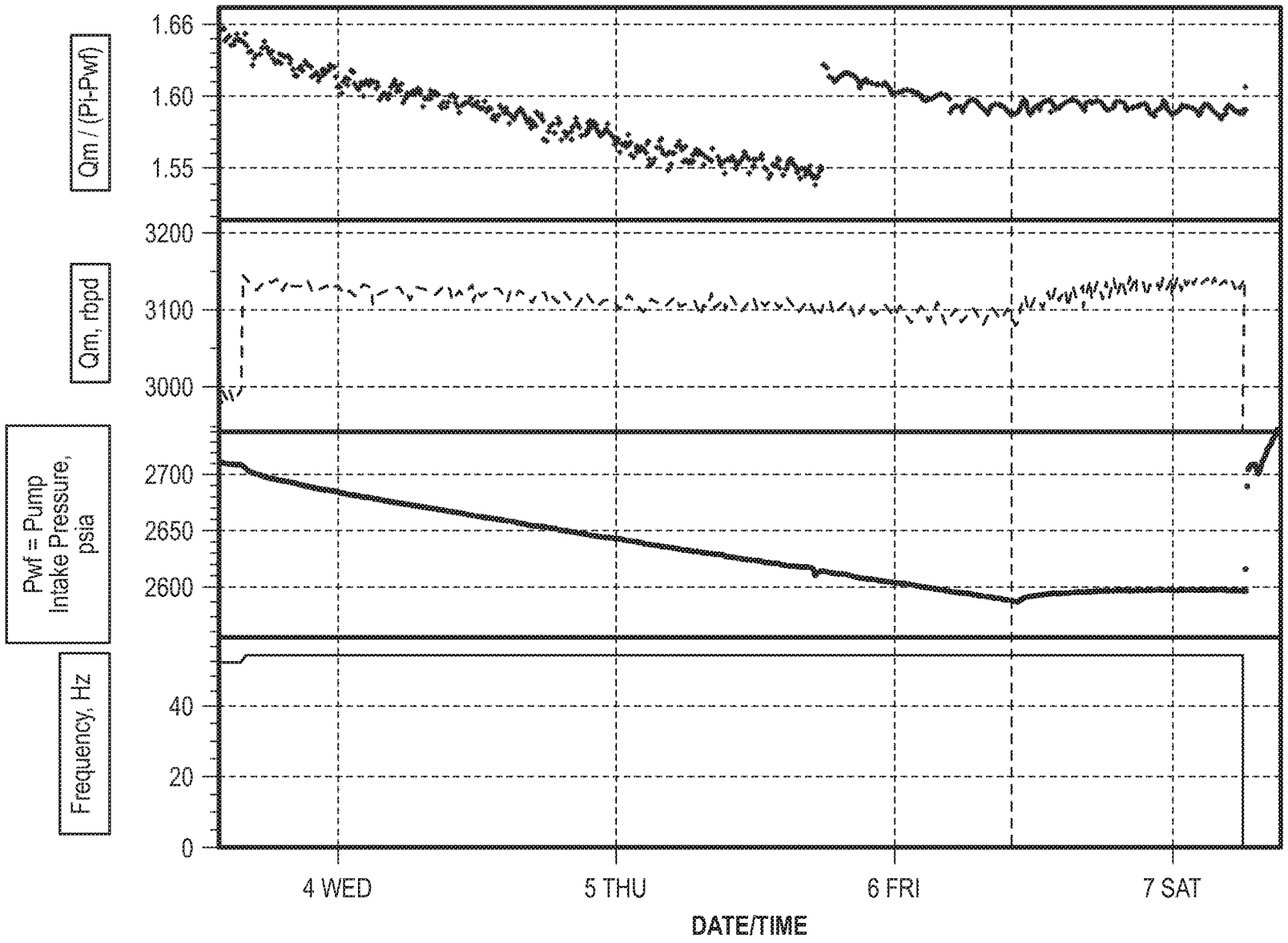
FIG. 5 is a graphical illustration showing detection of a tubing leak, according to an embodiment of the disclosure.
Figure 6:
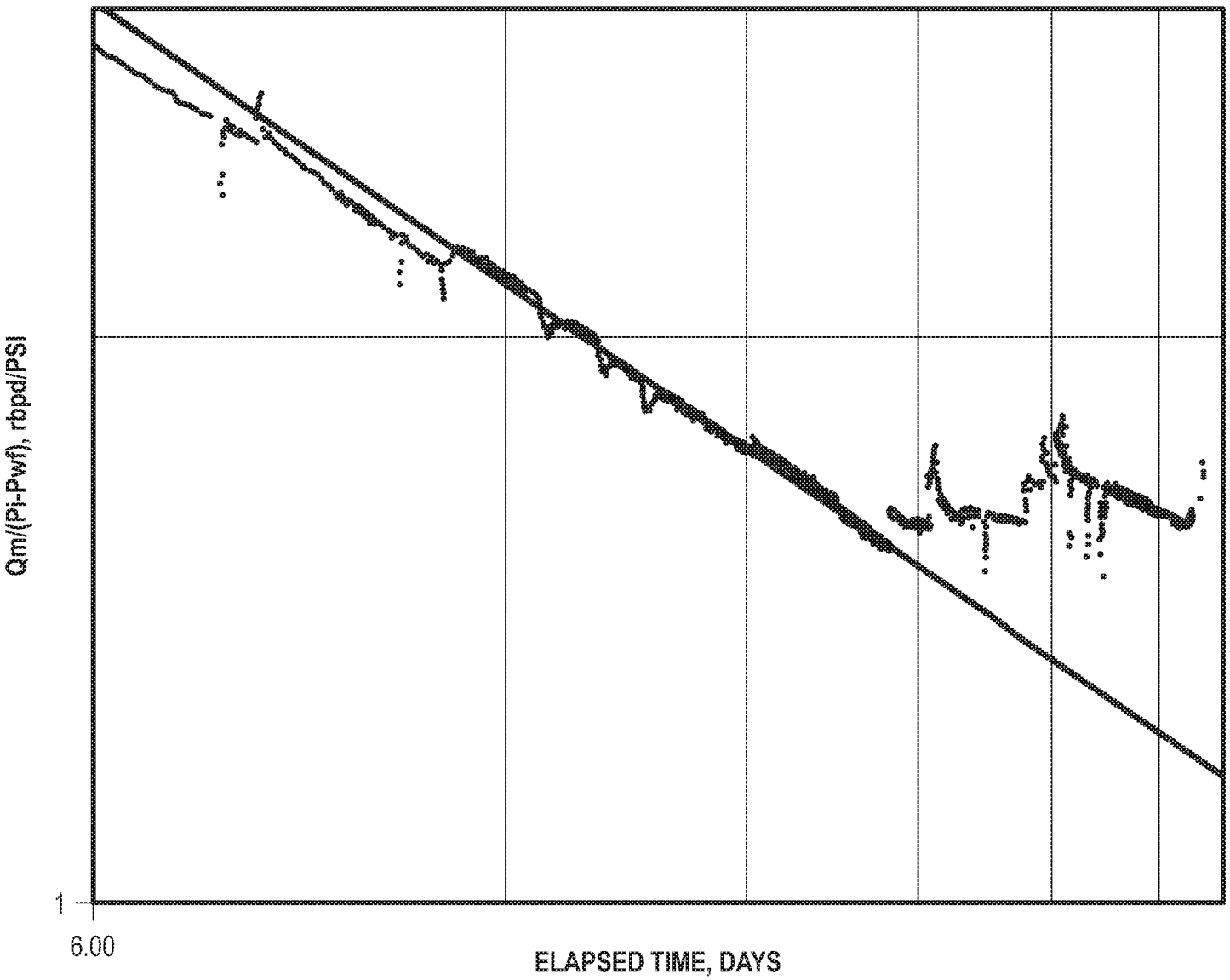
FIG. 6 is a graphical illustration showing a log-log plot of a flow regime over multiple days based on data from the downhole sensor system, according to an embodiment of the disclosure.

FIGS. 4-6 provide similar graphical illustrations of data that can be used to detect a tubing leak early on. However, the data in this example was obtained from an unconventional well application, namely a multi-stage fracing of horizontal well application. The data once again shows how a tubing leak can be detected with both $Q_m/(P_i-P_{wf})$ and its inverse. FIG. 5 illustrates that the tubing leak can be detected with the rate and pressure plots; however, the $Q_m/(P_i-P_{wf})$ plot provides confirmation of the tubing leak. As further illustrated in FIG. 6, a log-log plot may similarly be used to accentuate the change in slope as the time exponent becomes the slope. In this particular example, the flow regime prior to the tubing leak is linear fracture flow with half slope.

In these examples, because leak detection is based on the derivative of the inverse of the rate-normalized pressure difference, the absolute accuracy of the flow rate is of no consequence as long as a repeatability is good. As a result, the downhole sensors, e.g. flowmeters, need not be calibrated. This type of leak detection technique and the ability to detect tubing links early may be used in many types of well applications and well services.

For example, the technique may be utilized with a production composite log service, such as production composite log services available from Schlumberger. These types of services may be used in many types of wells, including electric submersible pumping system wells equipped with downhole gauges measuring, for example, intake and discharge. It should further be noted the downhole sensors may comprise a variety of gauges and devices able to detect and monitor the desired parameters, e.g. flow rate and flowing pressure. Examples of suitable sensors include WellWatcher gauges available from Schlumberger.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of downhole monitoring, comprising:
locating a tubing string in a borehole;
providing a flow of fluid through the tubing string;
positioning a sensor along the tubing string to obtain data related to the flow of fluid;
obtaining data related to the flow of fluid; and
based on the data related to the flow of fluid, determining a sloped change of the inverse of the rate-normalized pressure difference to provide a unique indicator of a tubing leak.

2. The method as recited in claim 1, wherein providing the flow of fluid comprises operating an electric submersible pumping system.

3. The method as recited in claim 1, wherein positioning a sensor comprises positioning a flowmeter downhole along the tubing string.

4. The method as recited in claim 1, wherein the sensor is configured to obtain data on flowing pressure along the tubing string.

5. The method as recited in claim 1, further comprising converting the data to a log-log plot.

6. The method as recited in claim 1, further comprising automating the detection of the tubing leak.

7. A method of detecting a tubing leak in a well, the method comprising:
obtaining data related to a flow of fluid through a tubing string deployed in the well; and
processing the data to detect the tubing leak by identifying a rate-normalized pressure drop and a change in a derivative of an inverse of the rate-normalized pressure drop.

8. The method of claim 7, further comprising providing an alarm when the tubing leak is detected.

9. The method of claim 7, wherein obtaining data comprises obtaining data from one or more sensors disposed upstream of the tubing leak.

10. The method of claim 7, wherein processing the data comprises creating a plot of $Q_m/(P_i-P_{wf})$ with respect to time, where $Q_m$ is a total downhole fluid flow rate at a monitored location, $P_i$ is an initial reservoir pressure, and $P_{wf}$ is a downhole fluid flow pressure at the monitored location.

11. The method of claim 10, wherein processing the data comprises creating a log-log plot of $Q_m/(P_i-P_{wf})$ with respect to time.

12. The method of claim 10, wherein the tubing leak is detected when Qm/(Pi−Pwf) begins increasing over time.

13. The method of claim 10, wherein the tubing leak is detected when a slope of the plot changes and becomes positive.

14. A system for detecting a tubing leak in a well, the system comprising:
at least one sensor disposed along a tubing string deployed in the well; and
a processor configured to:
receive data from the at least one sensor;
process the data to identify a rate-normalized pressure drop and a change in a derivative of an inverse of the rate-normalized pressure drop; and
output information indicative of the tubing leak to a user.

15. The system of claim 14, the processor configured to create a plot of $Q_m/(P_i-P_{wf})$ with respect to time, where $Q_m$ is a total downhole fluid flow rate at a monitored location, $P_i$ is an initial reservoir pressure, and $P_{wf}$ is a downhole fluid flow pressure at the monitored location, and wherein the information comprises the plot.

16. The system of claim 15, the processor configured to automatically detect the tubing leak based on $Q_m/(P_i-P_{wf})$ beginning to increase over time.

17. The system of claim 14, further comprising an alarm, the processor configured to trigger the alarm when the tubing leak has been detected.

18. The system of claim 14, wherein the at least one sensor is disposed upstream of the tubing leak.

19. The system of claim 14, wherein the at least one sensor comprises a flowmeter.

* * * * *